US009638446B2

(12) United States Patent
Kleinow et al.

(10) Patent No.: US 9,638,446 B2
(45) Date of Patent: May 2, 2017

(54) METHOD TO DETECT LOW CHARGE LEVELS IN A REFRIGERATION CIRCUIT

(71) Applicant: MAHLE International GmbH, Stuttgart (DE)

(72) Inventors: Aaron Kleinow, Clarkston, MI (US); Joseph Lewis, Rochester Hills, MI (US); Lawrence Wei, Berkeley, MI (US); Ronald Goubeaux, West Bloomfield, MI (US)

(73) Assignee: MAHLE International GmbH, Stuttgart (DE)

( * ) Notice: Subject to any disclaimer, the term of this patent is extended or adjusted under 35 U.S.C. 154(b) by 350 days.

(21) Appl. No.: 14/475,873

(22) Filed: Sep. 3, 2014

(65) Prior Publication Data

US 2016/0061500 A1 Mar. 3, 2016

(51) Int. Cl.

| | |
|---|---|
| ***F25B 45/00*** | (2006.01) |
| ***F25B 49/00*** | (2006.01) |
| ***F25B 49/02*** | (2006.01) |

(52) U.S. Cl.

CPC ..... *F25B 49/005* (2013.01); *F25B 49/022* (2013.01); *F25B 2500/24* (2013.01); *F25B 2600/01* (2013.01); *F25B 2600/0251* (2013.01); *F25B 2700/193* (2013.01); *F25B 2700/2106* (2013.01)

(58) Field of Classification Search

CPC ..... F25B 2345/00; F25B 2345/001; F25B 2345/002; F25B 2345/003; F25B 45/00; F25B 2500/22; F25B 2500/221; F25B 2500/222; F25B 2500/23; F25B 2500/24; F25B 2700/19; F25B 2700/193; F25B 2700/1931; F25B 2700/1933; F25B 2700/195; F25B 2700/197; F25B 2700/21162; F24F 2011/0013

See application file for complete search history.

(56) References Cited

U.S. PATENT DOCUMENTS

| | | | | |
|---|---|---|---|---|
| 4,796,436 | A * | 1/1989 | Voorhis | F25B 45/00 62/149 |
| 5,481,884 | A * | 1/1996 | Scoccia | F25B 49/005 62/127 |
| 5,623,834 | A * | 4/1997 | Bahel | F25B 49/005 62/131 |
| 6,058,107 | A * | 5/2000 | Love | H04W 52/143 370/252 |
| 6,318,097 | B1 | 11/2001 | Wieszt | |
| 7,594,407 | B2 | 9/2009 | Singh et al. | |
| 2005/0102029 | A1 * | 5/2005 | Blain | A61F 2/442 623/17.13 |
| 2008/0292044 | A1 * | 11/2008 | Saito | G01R 33/04 377/55 |

(Continued)

FOREIGN PATENT DOCUMENTS

DE 199 35 269 C1 1/2001

*Primary Examiner* — Ryan J Walters
*Assistant Examiner* — Erik Mendoza-Wilkenfe
(74) *Attorney, Agent, or Firm* — Muncy, Geissler, Olds & Lowe, P.C.

(57) ABSTRACT

A method to detect the charge level of a refrigerant within a refrigeration circuit, where the refrigeration circuit has a compressor, a sensor to detect a pressure, and a sensor to detect a temperature. The method has a key cycle that has a first part and a second part.

14 Claims, 3 Drawing Sheets

(56) References Cited

U.S. PATENT DOCUMENTS

| | | | | |
|---|---|---|---|---|
| 2010/0088046 | A1* | 4/2010 | Schuster | F25B 49/005 702/50 |
| 2010/0186430 | A1* | 7/2010 | Johnston | B60H 1/00585 62/77 |
| 2011/0112814 | A1* | 5/2011 | Clark | F25B 49/005 703/9 |
| 2013/0002446 | A1* | 1/2013 | Smith | F25B 49/005 340/815.4 |
| 2014/0266141 | A1* | 9/2014 | Isham | H02M 3/157 323/318 |
| 2015/0007591 | A1* | 1/2015 | Liu | G01K 13/02 62/77 |

* cited by examiner

METHOD TO DETECT LOW CHARGE LEVELS IN A REFRIGERATION CIRCUIT

BACKGROUND OF THE INVENTION

Field of the Invention

The present invention relates to a method to detect the charge level of a refrigerant within a refrigeration circuit, where the refrigeration circuit comprises a compressor, a sensor to detect a pressure of the refrigerant and a sensor to detect a temperature, with the method comprising a key cycle that has a first part and a second part.

Description of the Background Art

Within refrigeration circuits a compressor is used to compress a refrigerant, which is circling within the refrigeration circuit. Thus a high pressure side and a low pressure side are created. The compressor needs sufficient lubrication to prevent the compressor from failure.

In an ideal refrigeration circuit the whole lubricant would remain in the compressor to ensure the lubrication of the moving parts of the compressor. In reality the lubricant mixes with the refrigerant, which is compressed by the compressor. The lubricant is discharged out of the compressor with the refrigerant and flows into the remaining refrigeration circuit. The amount of lubricant within the compressor is thus reduced. Typically the lubricant will be transported back into the compressor with the circulating refrigerant.

The physical condition of the refrigerant can be either liquid or gaseous within the refrigeration circuit, where the refrigerant has better transport capabilities for the lubricant in the liquid state than in the gaseous state.

Due to the inevitable loss of the refrigerant from the refrigeration circuit due to leaks or other influences the refrigerant level in the refrigeration circuit can be reduced, which results in a decreased cooling performance. Furthermore a lower level of refrigerant decreases the capability to transport the lubricant through the refrigeration circuit and back to the compressor. At a certain refrigerant charge level the transport capability can be that low that a sufficient lubrication of the compressor cannot longer be maintained. The insufficient lubrication will inevitably lead to compressor damage.

Solutions are known in the conventional art, which use elements to constantly measure the level of refrigerant within the refrigeration circuit to prevent compressor damage. In one application the cycle rate of a cycling clutch orifice tube system is monitored, where lower refrigerant levels will result in faster cycle rates. In another application the system response rates of a variable compressor stroke change is monitored, where lower refrigerant levels will result in faster response rates.

The document DE 199 35 269 C1, which corresponds to U.S. Pat. No. 6,318,097, shows a method to evaluate the charge level of the refrigerant within a refrigeration device, where the temperature and the pressure on the high pressure side is measured periodically and a predetermined temperature value is calculated from a refrigerant specific equation, where the predetermined temperature is subtracted from the measured temperature to obtain a value, from which a conclusion about the refrigerant charge level can be made.

The document U.S. Pat. No. 7,594,407 B2 shows a method to monitor the refrigerant within a refrigeration system, where a saturation temperature of the refrigerant is calculated based on at least one of a discharge pressure and a discharge temperature of the refrigeration device.

The disadvantage of the applications and methods known in the conventional art is that either additional elements such as sensors or orifice tubes are required or that the compressor needs to be a variable stroke compressor. The additional parts and/or the variable stroke compressor make the refrigeration circuit more complex and more expansive.

SUMMARY OF THE INVENTION

It is therefore an object of the present invention to provide a method to monitor the refrigerant level within a refrigeration circuit without the need for additional parts and/or a specific compressor within the refrigeration circuit.

According to an embodiment of the invention a method to detect the charge level of a refrigerant within a refrigeration circuit is given, having a compressor to compress a refrigerant, a sensor to detect a pressure, and a sensor to detect a temperature. The method has a key cycle that includes a first part and a second part, with the first part comprising: detecting of a pressure $p_s$ in the refrigeration circuit; detecting of an ambient temperature $t_a$; comparing the ambient temperature $t_a$ with a given threshold temperature $t_{min}$; comparing the pressure $p_s$ to a given threshold pressure $p_{t1}$; counting up a first counter $C_1$ each time the pressure $p_s$ is compared to the threshold pressure $p_{t1}$; with the first part being started over if the pressure $p_s$ is below the threshold pressure $p_{t1}$ and the ambient temperature $t_a$ is above the threshold temperature $t_{min}$, with the second part being started if the pressure $p_s$ is above the threshold pressure $p_{t1}$. The second part can include: detecting the pressure $p_s$; detecting the ambient temperature $t_a$; using $t_a$ to determine pass/fail pressure $p_{t2}$; comparing the pressure $p_s$ against a predetermined pass/fail pressure $p_{t2}$; a second counter $C_2$ counting up each time the pressure $p_s$ is compared against the pass/fail pressure $p_{t2}$; a third counter $C_3$ counting up each time the pressure $p_s$ is below the pass/fail pressure $P_{t2}$, with the second part being started over after the comparison between pressure $p_s$ and pass/fail pressure $p_{t2}$, where the values of the counters $C_1$, $C_2$ and $C_3$ are combined to an overall value after the end of one key cycle and being compared to a threshold value $V_{LC}$, which represents a predetermined low charge level of the refrigerant within the refrigeration circuit.

The detection of the pressure $p_s$ and the detection of the ambient temperature $t_a$ in the first part and/or in the second part can be made either simultaneously or in sequence. The values for the pressure $p_s$ and ambient temperature $t_a$ in the second part can either be obtained by a new detection or by using the last values for the pressure $p_s$ and the ambient temperature $t_a$ of the first part. The pressure $p_s$ is preferably a pressure within the refrigeration circuit, e.g. the pressure of the refrigerant. The ambient temperature $t_a$ is preferably a temperature outside of the refrigeration circuit, e.g. the air temperature of the surrounding air.

The comparison of the ambient temperature $t_a$ against the threshold temperature $t_{min}$ can be made before, after or simultaneously with the comparison of the pressure $p_s$ against the threshold pressure $p_{t1}$. In an embodiment the pressure $p_s$ is only checked against the threshold pressure $p_{t1}$ if the ambient temperature $t_a$ is above the threshold temperature $t_{min}$, because only then is the engagement of the compressor possible, as the threshold temperature $t_{min}$ defines the lower limit of the temperature window, in which the operation of the compressor is permissible. The threshold temperature $t_{min}$ can be set with regard to the ambient temperatures that normally can be expected around the vehicle. The threshold pressure $p_{t1}$ is preferably set with regard to the technical design of the refrigeration circuit.

It is especially advantageous that the whole method can be used without the need for any additional sensors or a special kind of compressor. Refrigeration circuits usually have at least one sensor to detect the pressure of the refrigerant, because the pressure is also needed for various other applications. The same is eligible for the sensor for the detection of the ambient temperature, which is also needed for various other applications. The sensor to detect the ambient temperature does not have to be installed within or nearby the refrigeration circuit. The compressor itself and especially the technical design are not crucial for the method to work. It can be employed with virtually any kind of compressor.

In an embodiment, the compressor can be disengaged within the first part and can be engaged within the second part. Within the first part the pressure $p_s$ is at the beginning too low to safely engage the compressor. With the pressure $p_s$ growing after the operation of the compressor is requested the threshold pressure $p_{t1}$ can be reached and thus the compressor can be engaged, which leads into the second part where the compressor is engaged.

The values of the counter $C_1$ and/or $C_2$ and/or $C_3$ can be weighted by a given mathematical function or by using a table of predetermined values before they are combined to an overall value. The weighting of the counter values is beneficial, as the different values can be adjusted with respect to their individual importance.

The weighted or not weighted values of the counters $C_1$, $C_2$ and $C_3$ can be totaled up to an overall value by using the function: value of $C_1$+(value of $C_3$/value of $C_2$). With a function as mentioned before it is easily possible to reach an overall value, which reflects the sum of the value of counter $C_1$ and the relation between the values of counter $C_3$ and counter $C_2$. The relation between the values of counter $C_3$ and Counter $C_2$ hereby reflect the total number of comparisons in the second part to the number of failed comparisons in the second part.

Furthermore it is beneficial, if the value of counter $C_1$ and/or $C_2$ and/or $C_3$ is weighted in dependency to the detected ambient temperature $t_a$, where higher temperatures $t_a$ lead to higher weightings.

This is done to ensure that the counts at higher ambient temperatures $t_a$ have a higher weight as counts at lower ambient temperatures $t_a$. This is beneficial as especially at higher ambient temperatures $t_a$ the risk of damage or failure is higher as at lower ambient temperatures $t_a$. Furthermore counts at higher ambient temperatures $t_a$ have a higher reliability to be accurate than counts at lower ambient temperatures $t_a$. The values of the counters can either be weighted with every single count of the respective counter or for each counter after the conclusion of one key cycle. Preferably the values are weighted with every count of the respective counter, as this gives a more precise picture of the overall situation, especially if a key cycle covers a greater time length, as the ambient temperature $t_a$ can change throughout a single key cycle.

In an embodiment, the pass/fail pressure $p_{t2}$ can be set in dependency of the detected ambient temperature $t_a$.

This is advantageous, as it allows adapting the pass/fail pressure $p_{t2}$ to the respective ambient temperature $t_a$ at the moment of the comparison. The ambient temperature $t_a$ has a high influence on the pressure $p_s$ within the refrigeration circuit and other relevant factors, therefore it is important to adapt the pass/fail pressure $p_{t2}$ with regard to the ambient temperature $t_a$ to increase the precision of the method.

The pass/fail pressure $p_{t2}$ can either be adapted periodically throughout a key cycle or can be set for a complete key cycle. The pass/fail pressure $p_{t2}$ can be adapted with each individual detection of the ambient temperature $t_a$ to ensure that sudden and drastic changes of the ambient temperature $t_a$ are sufficiently incorporated into the method. Especially a scenario where a vehicle is used in conditions with drastic changes of the ambient temperature $t_a$, e.g. driving a vehicle out of a cool garage into a hot surrounding, could otherwise lead to misinterpretation and thus to unnecessary disengagements of the compressor.

The threshold pressure $p_{t1}$ can be set in dependency of the detected ambient temperature $t_a$. To reach better and more reliable results it is important to factor in the possibility of a sudden change of the ambient temperature $t_a$ into the method and therefore set the threshold pressure $p_{t1}$ in dependency to the ambient temperature $t_a$.

The key cycle can be defined by a predetermined time span after which the method is started over again. This is beneficial to ensure that in a defined time span a defined number of key cycles will be completed to reach a certain amount of weighted overall values. Preferably the time span is between three to six minutes, even more preferred is a time span of five minutes.

A key cycle of a predetermined length could end without even beginning the second part, as the second part is only started, when the pressure $p_s$ is above the threshold pressure $p_{t1}$. But as the whole key cycle can be only started when the operation of the compressor is requested it is highly likely that the pressure $p_s$ will rise above the threshold pressure $p_{t1}$ before the end of one single key cycle. To further improve the reliability of the method by guaranteeing the switch from the first part into the second part it is beneficial, if the time span of the key cycle is set long enough to allow the pressure $p_s$ to be raised sufficiently to allow a safe engagement of the compressor.

In an embodiment an override could be used, to ensure the key cycle to last at least until the second part is completed once or a given number of times to obtain valid values of all three counters and an accumulated overall value.

Moreover, the respective overall values of more than one of the previous key cycles can be stored and compared individually to the threshold value $V_{LC}$.

This is advantageous to improve the confidence in the result of the comparison, as the comparison of several consecutive overall values to the threshold value $V_{LC}$ leads to a more reliable result, as the probability for a single isolated miscalculation or misreading is significantly higher than for a series of miscalculations or misreads.

Furthermore the trend of the charge level can be determined by comparison of the forgoing results. To obtain the trend the stored overall values are compared individually to the respective threshold value $V_{LC}$ to derive the trend regarding the charge level of the refrigerant. If the comparison indicates a sinking charge level or a charge level that is continuously below the low charge level, which is represented through the threshold value $V_{LC}$, the compressor is disengaged to protect the compressor from failure or damage due to insufficient lubrication.

Furthermore, the method can be only used if the vehicle speed is above idle for a predetermined time and/or if the gradient of the ambient temperature $t_a$ slips below a predetermined limit. This is beneficial to ensure that the method will not be affected by sudden changes of the ambient temperature $t_a$, which can easily occur after long periods of idle.

The compressor can be disengaged respectively the engagement will be avoided if the ambient temperature $t_a$ is below the threshold temperature $t_{min}$ while the first part. This is to make sure that the compressor will only be engaged if the ambient temperature $t_a$ is above a certain predetermined value to avoid the engagement of the compressor, when it actually is not needed. If for any reasons the compressor is already engaged, it will be disengaged due to the ambient temperature $t_a$ being below the predetermined threshold temperature $t_{min}$.

Furthermore, the compressor can be engaged if the ambient temperature $t_a$ is above the threshold temperature $t_{min}$ and the pressure $p_s$ is above the threshold pressure $p_{t1}$. While the first part is repeated the pressure $p_s$ raises until the threshold pressure $p_{t1}$ is finally reached and the second part is started. As the whole method is preferably only started when the operation of the compressor is requested, the engagement of the compressor after reaching the predetermined limits $t_{min}$ and $p_{t1}$ is beneficial.

According to an embodiment of the invention, the compressor can be disengaged if the comparison between the overall value and the threshold value $V_{LC}$ shows a trend for low charge levels of the refrigerant within the refrigeration circuit. This is beneficial, as the compressor will be disengaged before damage or failure due to insufficient lubrication will occur. In an embodiment the compressor can also be disengaged, if only one comparison shows a lower overall value than the threshold value $V_{LC}$. By using a trend and thereby a number of comparisons the confidence in the method and hence the reliability can be improved.

In an embodiment, the key cycle can be only started when operation of the compressor is requested. Only if the operation of the compressor is requested, by occupants of the vehicle or other regulating components, it becomes necessary to control the charge level of the refrigerant in order to make sure that it is high enough to guarantee a sufficient lubrication of the compressor through the lubricant, which is transported with the refrigerant. Therefore it is not necessary to monitor the charge level of the refrigerant if the compressor is not engaged.

Furthermore, the compressor can be a cycling fixed displacement compressor. In alternative embodiments, other compressor designs could be used to employ the method of the present invention.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
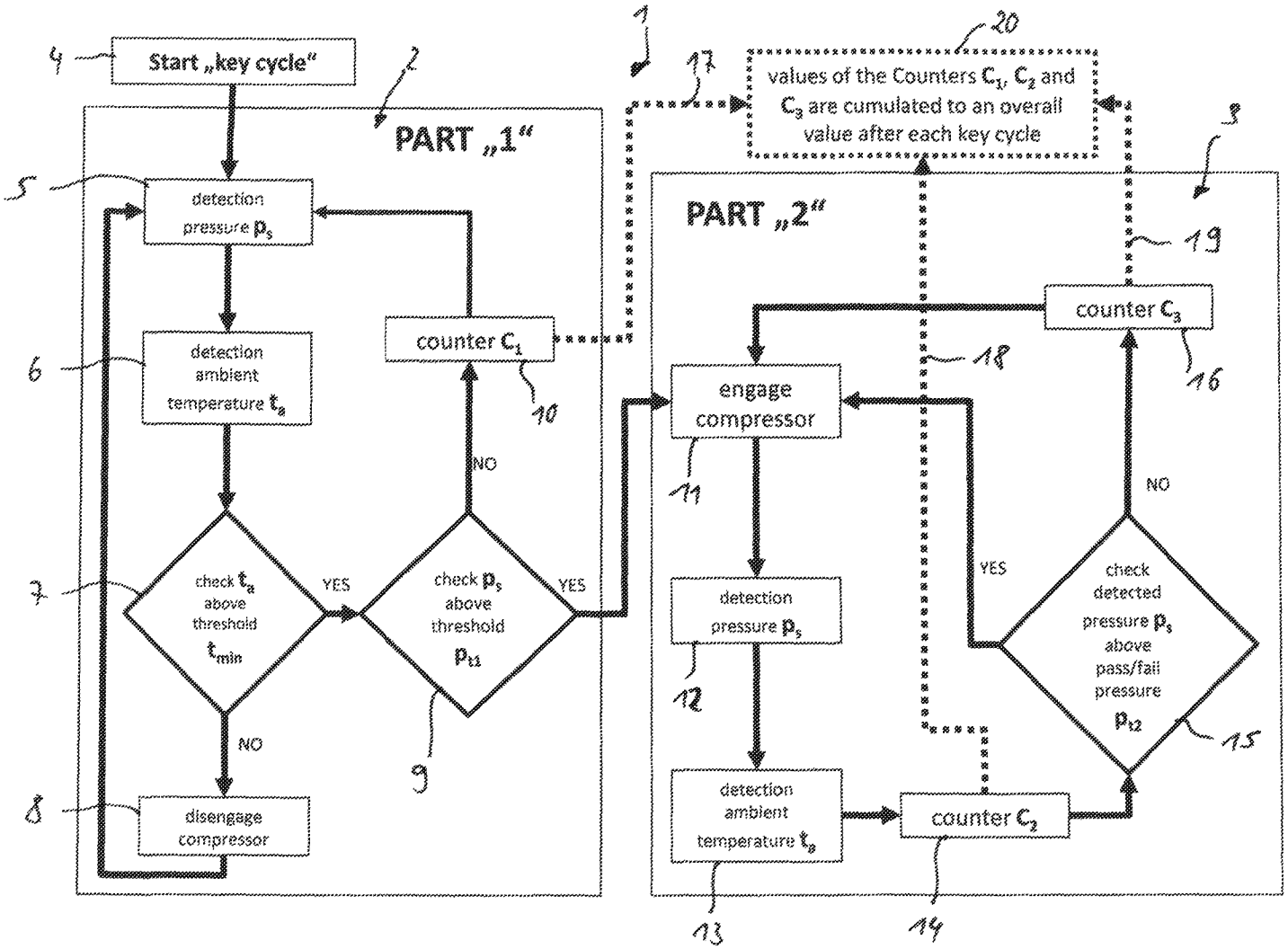
FIG. 1 shows a flow chart of the method, which is used to detect a low charge level of the refrigerant within the refrigeration circuit.

FIG. 1 shows a flow diagram of the method used to detect a low refrigerant level within a refrigeration circuit. The method comprises a key cycle 1 that has two parts, with one being the first part 2 and the other being the second part 3.

The method is started in box 4 where a key cycle 1 is started. The key cycle 1 can last a predetermined amount of time or an otherwise limited time period. In a preferable embodiment a key cycle is characterized by a time span that is long enough to allow the pressure $p_s$ within the refrigeration circuit to raise enough to safely engage the compressor of the refrigeration circuit. The method is usually started when a request for the engagement of the compressor has been issued by either an occupant of the vehicle or by any other regulating components of the vehicle, which is capable of requesting the engagement.

After the start of the key cycle 1 in box 4 a pressure $p_s$ is detected in box 5. The detection is preferably done by a sensor capable of either detecting a pressure directly or indirectly through other means. The pressure $p_s$ can be the pressure of the refrigerant itself in the refrigeration circuit or other pressures, which allow a conclusion of the pressure of the refrigerant. In box 6 the ambient temperature $t_a$ is detected. Therefore a temperature sensor can be used. The ambient temperature $t_a$ can also be acquired by using data of sensors that typically are not related to the refrigeration circuit itself, e.g. the sensor for the temperature display in a vehicle.

The boxes 5 and 6 can be arranged in virtually any order. The ambient temperature $t_a$ and the pressure $p_s$ can be detected simultaneously or in sequence.

In box 7 a first check is conducted, where the detected ambient temperature $t_a$ is compared to a defined threshold temperature $t_{min}$. The threshold temperature $t_{min}$ can be fixed for all key cycles or can be adjusted with respect to the detected ambient temperature $t_a$ or other relevant reference figures. If the ambient temperature $t_a$ is below the threshold temperature $t_{min}$, the process leads on to box 8 where the signal is issued that the compressor should be disengaged. If the compressor was actually not engaged at the moment of the check 7, the signal is issued to ensure that the compressor stays disengaged. The process starts over at box 5 with the detection of pressure $p_s$.

If the ambient temperature $t_a$ is above the threshold temperature $t_{min}$ in box 7, the process goes on to box 9, where the detected pressure $p_s$ is checked against a threshold pressure $p_{t1}$, which reflects a minimum pressure in the refrigeration circuit that is required to safely engage the compressor. If the pressure $p_s$ is below the threshold pressure $p_{t1}$, the process goes on to box 10, which represents a first counter $C_1$. The counter $C_1$ counts up every time the check at box 9 is performed and failed. The process then starts over again at box 5 with the detection of pressure $p_s$. The threshold pressure $p_{t1}$ is set in dependency from the ambient temperature $t_a$. It can either be set fixed for one defined key cycle 1 or can be periodically adjusted with each detection of the ambient temperature $t_a$.

If the pressure $p_s$ is above the threshold pressure $p_{t1}$, the process slips over into the second part 3.

The second part 3 starts at box 11 where the compressor is engaged when the pressure $p_s$ and the ambient temperature $t_a$, which have been detected in the first part 2, are above the respective limits so that the compressor can be safely engaged.

Following box 11 is box 12, where the pressure $p_s$ is detected again. Afterwards the ambient temperature $t_a$ is detected at box 13 again. As in the first part 2 the detection of the pressure $p_s$ and the ambient temperature $t_a$ can be made in different order or simultaneously. The boxes 12 and 13 might be repeated for a predetermined period of time, either fixed or event driven and/or either averaged or maximum values are used.

Following box 13 in the process is box 14, which represents a second counter $C_2$, which counts up every time the check in the following box 15 is conducted or in other words every time the second part 3 is passed through.

In the following box 15 the detected pressure $p_s$ is compared to a pass/fail pressure $p_{t2}$, which is dependent from the ambient temperature $t_a$ or another relevant reference figure. Preferably the pass/fail pressure $p_{t2}$ and the threshold pressure $p_{t1}$ from the first part 2 are both set in dependency from the respectively detected ambient temperature $t_a$. The pass/fail pressure $p_{t2}$ can either be set to a fixed value for a key cycle 1 or adjusted with every detection of the ambient temperature $t_a$.

If the pressure $p_s$ is above the pass/fail pressure $p_{t2}$, the process jumps back to box 11, where the compressor is still engaged. The process then runs again through the boxes 12, 13 and 14. This goes on as long as the pressure $p_s$ is above the pass/fail pressure $p_{t2}$. If the key cycle 1 only lasts a predetermined time, the method can end with the end of the time span of the key cycle 1.

If the pressure $p_s$ is however below the pass/fail pressure $p_{t2}$, the process goes on to box 16, which represents a third counter $C_3$. The counter $C_3$ counts up every time the check at box 15 is failed and the pressure $p_s$ is below the pass/fail pressure $p_{t2}$. From the counter $C_3$ in box 16 the process is directed back to box 11 and the second part 3 is started all over again.

After the end of the key cycle all values of the three counters $C_1$, $C_2$ and $C_3$ are cumulated together to an overall value. This is represented by the box 20, to which the values of the counters $C_1$, $C_2$ and $C_3$ are channeled along the dotted arrows 17, 18 and 19. This overall value is then compared to a predefined threshold value $V_{LC}$, which represents a low charge level within the refrigeration circuit. The low charge level can be set with respect to experience values or to absolute limits, which result from the technical design of the refrigeration circuit.

The values of the counter $C_1$, $C_2$ and $C_3$ can be cumulated by using a preset mathematical function. Preferably the values are cumulated by using a function where the value of $C_1$ is added to the relation between the value of $C_3$ and the value of $C_2$ (value of $C_1$+(value of $C_3$/value of $C_2$)). The overall value thus reflects the amount of failed checks in box 9 and the ratio of failed checks in box 15 to all conducted checks in box 15.

All values of the counters $C_1$, $C_2$ and $C_3$ can be used as they are or they can be weighted to achieve better results. In case of weighting the values can either be weighted after each individual count of the respective counter $C_1$, $C_2$ and $C_3$, after a certain number of counts of the counters or after the end of one key cycle 1.

The weighting factors are preferably dependent from either the ambient temperature $t_a$ or other relevant reference figures. In an embodiment the counts obtained at high ambient temperatures $t_a$ are weighted higher that the counts obtained at low ambient temperatures $t_a$, as higher ambient temperatures mean less cycling and more repeatable pressures, which leads to a better prediction quality for the charge level in the refrigeration circuit. Higher weighting for the counts at higher ambient temperatures reflect this.

The weighting can either be done by using graphs, which give certain weighting factors for different ambient temperatures $t_a$, or by using tables, which are filled with predetermined values.

Figure 2:
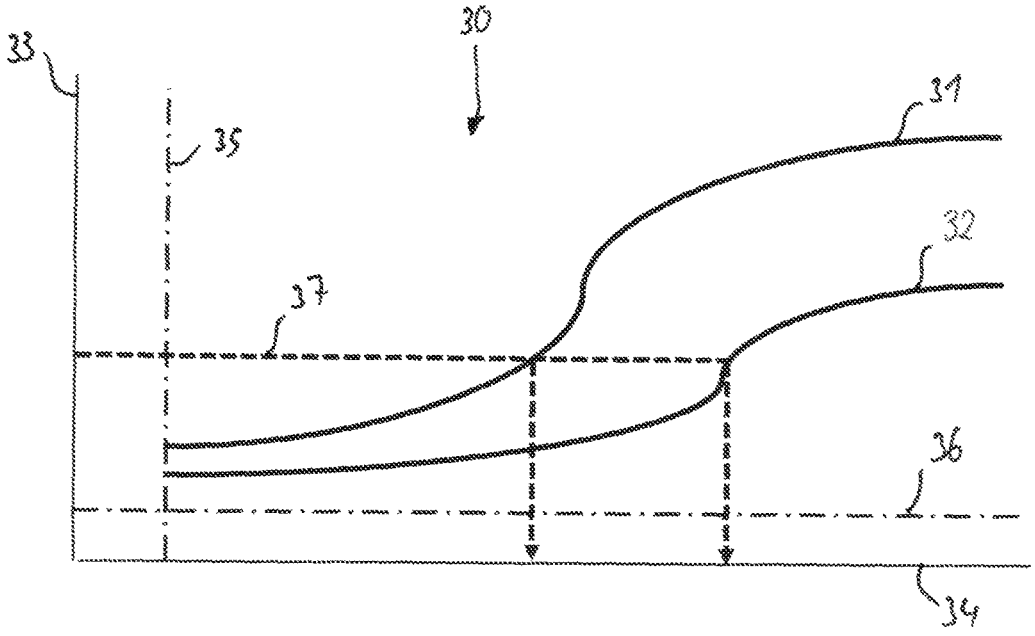
FIG. 2 shows a diagram with two graphs, where each graph represents a conversion line that can be used to correlate an ambient temperature $t_a$ to either a threshold pressure $p_{t1}$ or a pass/fail pressure $p_{t2}$.

FIG. 2 shows a diagram 30 with a first graph 31 and a second graph 32. The first graph 31 is a conversion line that allows determining the threshold pressure $p_{t1}$, which is used in the first part 2, with regard to the ambient temperature $t_a$. The second graph 32 is a conversion line that allows determining the pass/fail pressure $p_{t2}$, which is used in the second part 3, with regard to the detected ambient temperature $t_a$. The ambient temperature $t_a$ is plotted along the y-axis 33, whereas the pressure is plotted along the x-axis 34.

Furthermore the vertical chain dotted line 35 represents the minimum pressure that can be used for either threshold pressure $p_{t1}$ or pass/fail pressure $p_{t2}$. The horizontal chain dotted line 36 represents the threshold temperature $t_{min}$, which needs to be exceeded to allow the operation of the compressor.

For a given ambient temperature $t_a$, which is represented through the horizontal dotted line 37, a value for the threshold pressure $p_{t1}$ can be obtained from the conversion line 31 by going vertically down to the x-axis 34 from the point of intersection between the ambient temperature $t_a$ 37 and the first conversion line 31.

In a similar method the pass/fail pressure $p_{t2}$ can be obtained by going vertically down from the point of intersection between the ambient temperature $t_a$ 37 and the second conversion line 32.

Both conversion lines 31, 32 are generic and only reflect the main characteristics of an exemplary embodiment. As can be seen in FIG. 2 it is preferred, when the respective pressures $p_{t1}$ and $p_{t2}$ grow very slowly at first with respect to a growing ambient temperature $t_a$. That is represented through the very low gradient of the conversion lines 31 and 32 starting from the chain dotted line 35 of the minimal pressure.

Both conversion lines 31 and 32 are showing strongly increasing gradients that lead to strong growing pressures by even modest rises of the ambient temperature $t_a$. Both conversion lines 31 and 32 then go back to lower gradients, which result in slower growing pressures with a rising ambient temperature $t_a$.

In alternative embodiments the conversion lines could be vastly different. The conversion line is preferably oriented at the technical design of the refrigeration circuit and especially the compressor. Especially the minimum pressure, which is needed to safely engage the compressor (threshold pressure $p_{t1}$) or to keep the compressor safely engaged (pass/fail pressure $p_{t2}$), is important to form the conversion line in a way that leads to reasonable pressure values at all expectable ambient temperatures $t_a$. Generally the trend, in which higher ambient temperatures $t_a$ lead to higher pressures $p_{t1}$ and $p_{t2}$, should be incorporated in the chosen conversion lines.

Figure 3:
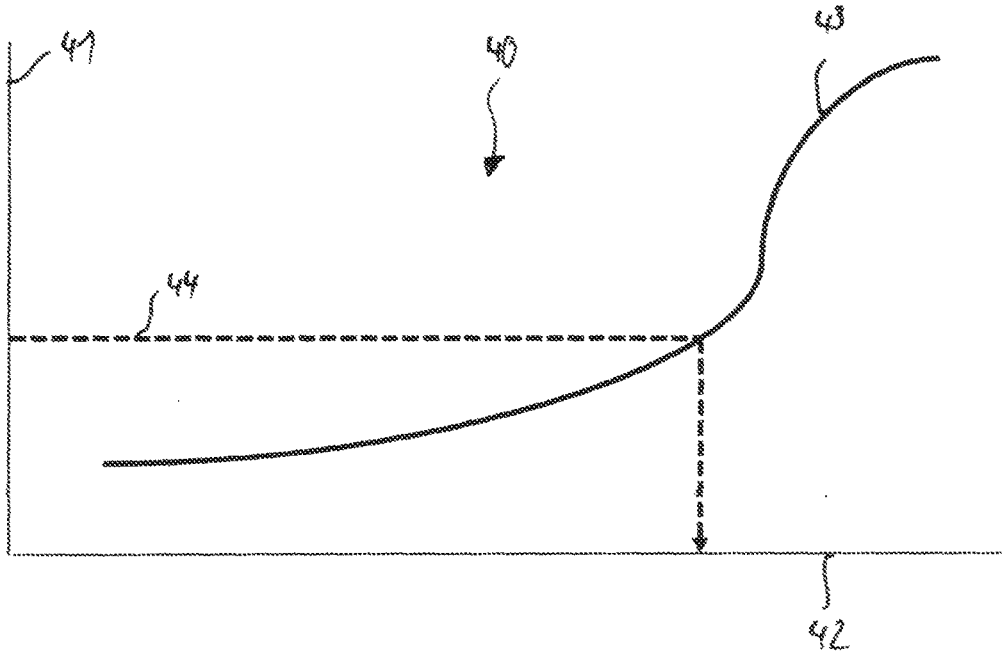
FIG. 3 shows a diagram with one graph, with the graph representing a conversion line, which represents the weighting factor that can be used for weighting the values of counter $C_3$ either with regard to the respective ambient temperature $t_a$ or with regard to another relevant reference figure.

FIG. 3 shows a diagram 40. The y-axis 41 shows the ambient temperature $t_a$, whereas the x-axis 42 shows a weighting factor for the values of counter $C_3$. The graph 43 shows a conversion line that allows determining a weighting factor for a given ambient temperature $t_a$. The conversion line 43 can be incorporated into the method to allow an instantaneous weighting of the values of counter $C_3$ at the instance they are counted. The values of the counter $C_3$ can either be weighted directly with every count of the counter with respect to the particular ambient temperature $t_a$ or after the end of a key cycle. The weighting of each value at the instance of the individual count gives a more precise picture, which is preferably.

For a given ambient temperature $t_a$ 44 a weighting factor can be obtained by going vertically downwards from the point of intersection between the ambient temperature $t_a$ 44 and the conversion line 43.

The conversion line 43 of FIG. 3 is just a generic sketch and only represents the basic characteristics of a preferred conversion line.

Figure 4:
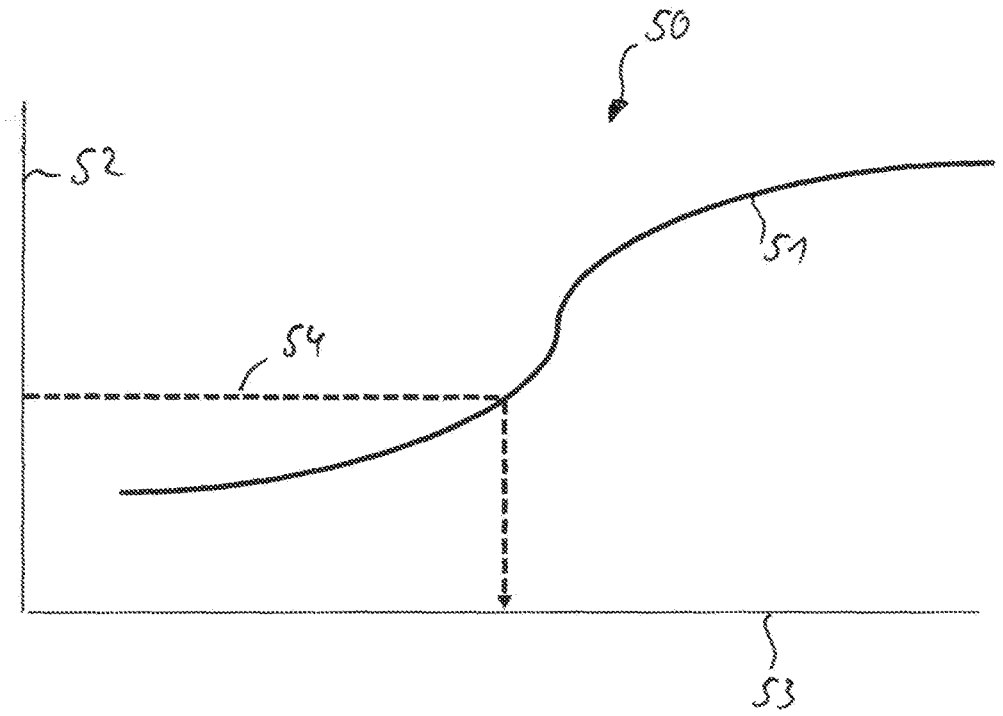
FIG. 4 shows a diagram with one graph, with the graph representing a conversion line, which represents the weighting factor that can be used for weighting the values of counter $C_1$ either with regard to the detected ambient temperature $t_a$ or with regard to another relevant reference figure.

FIG. 4 shows a diagram 50 that shows a conversion line 51. The y-axis 52 shows the counted value of the first counter $C_1$, whereas the x-axis 53 shows the weighting factor for the values of counter $C_1$. From a certain value of $C_1$ 54 a corresponding weighting factor can be obtained by vertically going down from the point of intersection from the value of $C_1$ 54 to the x-axis 53 showing the weighting factors for the values of $C_1$.

By using a conversion line 51, which in case of FIG. 4 is just a generic sketch, the values of the counter $C_1$ can be weighted to increase the precision of the method to detect a low charge level of the refrigerant.

The foregoing discloses and describes merely exemplary embodiments of the present invention. One skilled in the art will readily recognize from such discussion, and from the accompanying drawings and claims, that various changes, modifications and variations can be made therein without departing from the spirit and scope of the present invention.

Especially the conversion lines shown in FIGS. 2, 3 and 4 are only generic lines. They indicate the most characteristic qualities of the conversion lines preferably used for the present invention. Changes to the conversion lines can easily be made. In alternative embodiments tables can be used instead of conversion lines within the method without interfering with the scope of the invention.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A method to detect a charge level of a refrigerant within a refrigeration circuit, the method comprising:
- providing a compressor to compress a refrigerant;
- providing a sensor to detect a pressure;
- providing a sensor to detect a temperature; and
- performing a key cycle that has a first part and a second part,
- wherein the first part comprises:
  - detecting a pressure in the refrigeration circuit;
  - detecting an ambient temperature;
  - comparing the ambient temperature with a given threshold temperature;
  - comparing the pressure to a given threshold pressure;
  - counting up a first counter $C_1$ each time the pressure is compared to the threshold pressure, the first part being started over if the pressure is below the threshold pressure and/or if the ambient temperature is below the threshold temperature, with the second part being started if the pressure is above the threshold pressure, and
- wherein the second part comprises:
  - detecting the pressure;
  - detecting the ambient temperature;
  - comparing the pressure against a predetermined pass/fail pressure;
  - counting up a second counter $C_2$ each time the pressure is compared against the pass/fail pressure $p_{t2}$;
  - counting up a third counter $C_3$ each time the pressure is below the pass/fail pressure, the second part being started over after the comparison between the pressure and the pass/fail pressure, and
- wherein the values of the counters $C_1$, $C_2$ and $C_3$ are combined to an overall value after an end of the key cycle and are compared to a threshold value, which represents a predetermined low charge level of the refrigerant within the refrigeration circuit.

2. The method as claimed in claim 1, wherein the compressor is disengaged within the first part and is engaged within the second part.

3. The method as claimed in claim 1, wherein the values of the counter $C_1$ and/or $C_2$ and/or $C_3$ are weighted by a given mathematical function or by using a table of predetermined values before they are combined to an overall value.

4. The method as claimed in claim 1, wherein the values of the counter $C_1$ and/or $C_2$ and/or $C_3$ are weighted and are totaled up to an overall value by using a function: value of $C_1$+(value of $C_3$/value of $C_2$).

5. The method as claimed in claim 1, wherein the value of counter $C_1$ and/or $C_2$ and/or $C_3$ is weighted in dependency to the detected ambient temperature, and wherein higher temperatures lead to higher weightings.

6. The method as claimed in claim 1, wherein the pass/fail pressure is set in dependency of a detected ambient temperature.

7. The method as claimed in claim 1, wherein the threshold pressure is set in dependency of a detected ambient temperature.

8. The method as claimed in claim 1, wherein the key cycle is defined by a predetermined time after which the method is started over again.

9. The method as claimed in claim 1, wherein the respective overall values of more than one of the previous key cycles are stored and compared individually to the threshold value.

10. The method as claimed in claim 1, wherein the method is only used if the vehicle speed is above idle for a predetermined time and/or if a gradient of the ambient temperature slips below a predetermined limit.

11. The method as claimed in claim 1, wherein the compressor will be disengaged if the ambient temperature is below the threshold temperature.

12. The method as claimed in claim 1, wherein the compressor will be engaged if the ambient temperature is above the threshold temperature and the pressure is above the threshold pressure.

13. The method as claimed in claim 1, wherein the compressor is disengaged if the comparison between the overall value and the threshold value shows a trend for low charge levels of the refrigerant within the refrigeration circuit.

14. The method as claimed in claim 1, wherein the key cycle is only started when operation of the compressor is requested.

* * * * *